US005572941A

United States Patent [19]

Arnos

[11] Patent Number: 5,572,941

[45] Date of Patent: Nov. 12, 1996

[54] HAND/WRIST REST SUPPORT AND METHOD OF MAKING SAME

[76] Inventor: Tom J. Arnos, 996 Guildwood Blvd., London, Ontario, Canada, N6H 4G3

[21] Appl. No.: 347,285

[22] Filed: Nov. 30, 1994

[51] Int. Cl.[6] ..... B68G 5/00; B41J 29/00

[52] U.S. Cl. ..... 112/475.06; 112/475.08; 248/118; 400/715

[58] Field of Search ..... 112/475.06, 475.08, 112/417, 440, 441; 248/118, 118.1, 118.3, 118.5, 918; 400/715

[56] References Cited

U.S. PATENT DOCUMENTS

| | | | |
|---|---|---|---|
| Re. 33,556 | 3/1991 | Berke . | |
| 4,481,556 | 11/1984 | Berke et al. . | |
| 4,482,063 | 11/1984 | Berke et al. . | |
| 4,482,064 | 11/1984 | Berke et al. . | |
| 4,913,390 | 4/1990 | Berke . | |
| 5,131,614 | 6/1992 | Garcia et al. . | |
| 5,158,255 | 10/1992 | Fuller . | |
| 5,163,646 | 11/1992 | Englehardt . | |
| 5,183,230 | 2/1993 | Walker et al. . | |
| 5,193,925 | 3/1993 | Foulke . | |
| 5,203,527 | 4/1993 | Rubey | 248/118 |
| 5,228,655 | 7/1993 | Garcia et al. . | |
| 5,234,186 | 9/1993 | Powell . | |
| 5,445,349 | 8/1995 | Hart | 248/118 |
| 5,451,020 | 9/1995 | Smith et al. | 248/118 |

*Primary Examiner*—Peter Nerbun
*Attorney, Agent, or Firm*—Dykema Gossett PLLC

[57] ABSTRACT

The hand/wrist rest support is for use with a computer keyboard. It includes an elongated base made from a fabric material and includes a flap portion which is designed to fit beneath the keyboard and a tubular cover portion in which is located a yieldable material forming the core for the cover portion. The cover portion is designed to rest against or in front of the keyboard to provide a yieldable hand/wrist rest to help maintain the wrists of the user in a neutral posture. The method of making the hand/wrist rest support is also disclosed including the steps of cutting, forming, stitching and assembling the elongated resilient core into the tubular cover portion.

14 Claims, 5 Drawing Sheets

HAND/WRIST REST SUPPORT AND METHOD OF MAKING SAME

BACKGROUND OF THE INVENTION

This invention relates to an apparatus on which the heel of the hands may be rested and more particularly a hand/wrist rest support which may be associated with a typewriter, a keyboard and the like, for resting wrists while using same. This invention also relates to the method of making the hand/wrist rest support.

Many industrial problems have been eliminated or minimized in the workplace including injury to the workers by carrying back breaking loads or from inhaling cancer-causing fibers and fumes, lung-damaging dust and other bodily threats. Such threats have often plagued blue-collar workers who often paid with their health or lives because of the industrial climate.

With workplace safeguards largely in place to control such risks, attention is now directed to offices, news rooms, and at switchboards, where growing numbers of persons who work hour after hour on computer keyboards are developing sometime crippling symptoms in their hands.

Some persons try to ignore the symptoms until they can no longer hold a coffee cup, let alone type or operate the keyboard. Other persons, frightened by the disabilities of co-workers, seek professional help before it's too late. Still other persons are banding together to seek changes in their computer equipment or office environment. Also employers and unions have begun to hire companies that specializes in ergonomics, the science of fitting the workplace to the worker, to redesign office equipment and train workers to use their bodies in less risky ways.

It may be hard to understand how working with something so seemingly innocuous, efficient and simple to use as a computer keyboard could damage the body. The problems are thought to stem from their very simplicity: workers in many businesses do almost nothing the entire day except press keys, making many thousands of strokes each hour. Many workers become keyboard athletes typing fast and furiously all day. However, few of them have trained, as athletes must, to perform their task with the proper technique. Many workers are relying on the equipment, that is the keyboards, monitors, tables and chairs, all of which are designed for someone else's body, if for anybody at all.

The result is often a form of over use syndrome, an injury that can be hard to diagnose, but nonetheless painful and incapacitating to the delicate structures within the wrist that make it possible to use the hands. For example, there is carpal tunnel syndrome, in which the nerve passing through the wrist becomes pinched by swollen tissues. The syndrome causes numbness and tingling in the fingers at first, then crippling pain, permanent nerve damage, and loss of muscle control that can render the hand almost useless. The disorder is but one of several hand-wrist problems that beset computer operators.

Researchers who have analyzed the conditions that seem to lead up to hand-wrist problems and clinicians who treat them have identified factors both within and outside the workplace that when properly adjusted can help prevent hand-wrist injuries.

A well designed chair not only helps protect the user's back but also reduces strain on the shoulders, neck and arms and ultimately the hands. Many experts recommend a chair that allows the user to adjust the height of the seat and the tilt of the back and possibly also of the seat. An adjustable table may also be necessary for people who are very tall or very short.

In addition, it has been found that a person should avoid resting the wrist on the edge of the work surface and to assist in such effort to reduce pressure on the wrist to use a padded wrist and palm rest in front of the keyboard. The prior art contains many examples of padded wrist rest supports to which this invention is directed.

SUMMARY OF THE PRESENT INVENTION

The present invention described and claimed herein relates to a hand/wrist rest support and to the method of making same. The hand/wrist rest support is designed for a user of a keyboard and the support is fully portable and may be disposed adjacent to a keyboard in accordance with the user's comfort.

The hand/wrist rest support includes a generally rectangular base folded into a configuration to form a flat portion and a tubular portion. The flat portion is designed to be placed beneath the keyboard while the tubular portion is filled with a foam material so as to occupy the interior of the tubular portion and form the padded area at the front of the keyboard and upon which the heel of the hands of the user rest when manipulating the keyboard.

The hand/wrist rest support includes a tubular foam or core with a relatively soft fabric cover covering the core. The relatively soft fabric allows a user's hands/wrists to move along the apparatus without frictional burns, or other injury to the skin which could result from the user of hard fabrics or materials. In addition, the use of a soft fabric such as cotton substantially eliminates or reduces the problem of sweating.

A feature of the present invention is the manner of making the hand/wrist rest including the steps of forming a generally rectangular base having a longitudinal axis, with the base having a pair of parallel longitudinal edges and a pair of parallel transverse end edges; folding the parallel transverse edges over the adjacent portions of the base to form end edges of double thickness; stitching the folded ends to the sheet; folding the parallel longitudinal edges over the adjacent portions of the base to form longitudinal edges of double thickness; stitching the folded longitudinal edges to the sheet to form double ply edges; folding the base at the longitudinal axis so that one half of the sheet lies on the other half of the sheet; stitching the two halves together along the longitudinal edges and partway along the parallel transverse edges to divide the sheet into a tubular cover portion and a flap portion; and inserting an elongated core element of foam material into the tubular cover portion to provide a cushion for the heel of the hands or wrists.

It is a further feature of the present invention to provide a hand/wrist rest support arrangement for use in association with a computer keyboard.

It is a still further feature of the present invention to provide a hand/wrist rest support which includes a resilient core which is removably carried by the support.

Still another feature of the present invention is to provide a hand/wrist rest support of the aforementioned type wherein the base includes a covering of a soft, absorbent and washable material such a cotton.

A further feature of the present invention is to provide a hand/wrist rest support which may be readily installed under and removed from the standard keyboard.

Another feature of the present invention is to provide a hand/wrist rest support that is economical to manufacture, easy to wash and maintain and is efficient in use with a computer keyboard.

These and other features will be apparent to a person skilled in the art after reading the following description and studying the drawings.

DETAILED DESCRIPTION OF A PREFERRED EMBODIMENT

The hand/wrist rest support of the present invention may come in different lengths and sizes to suit different computer systems.

Figure 1:
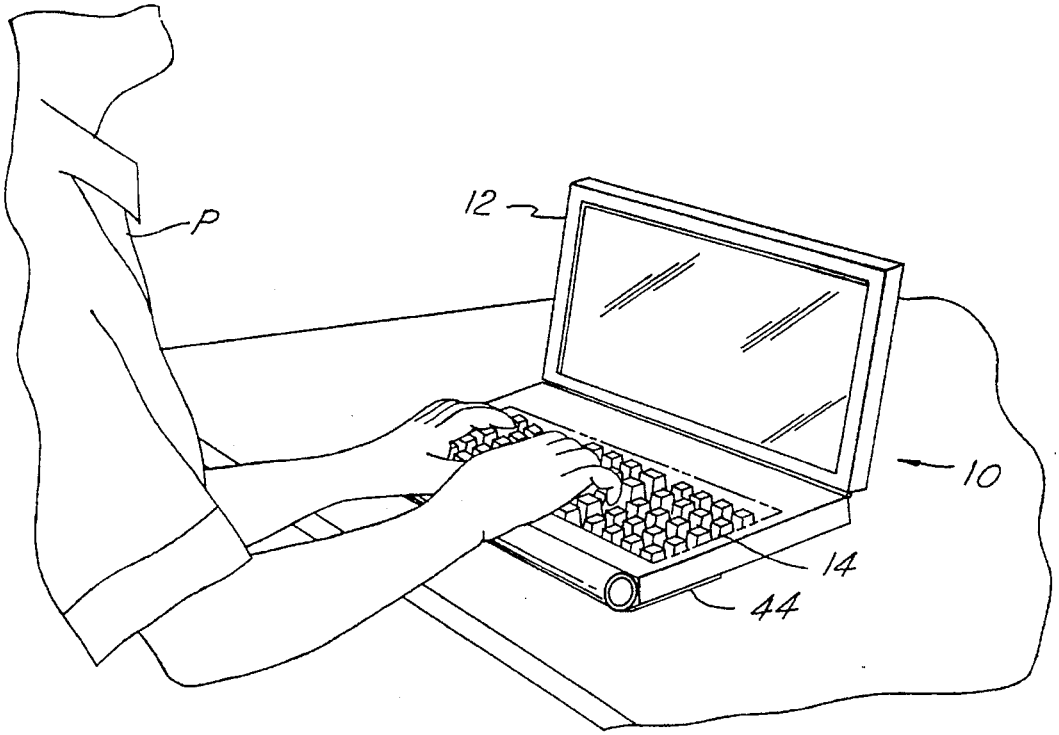
FIG. 1 is a perspective view of a notebook size computer and keyboard employing the hand/wrist rest support of the present invention.
Figure 2:
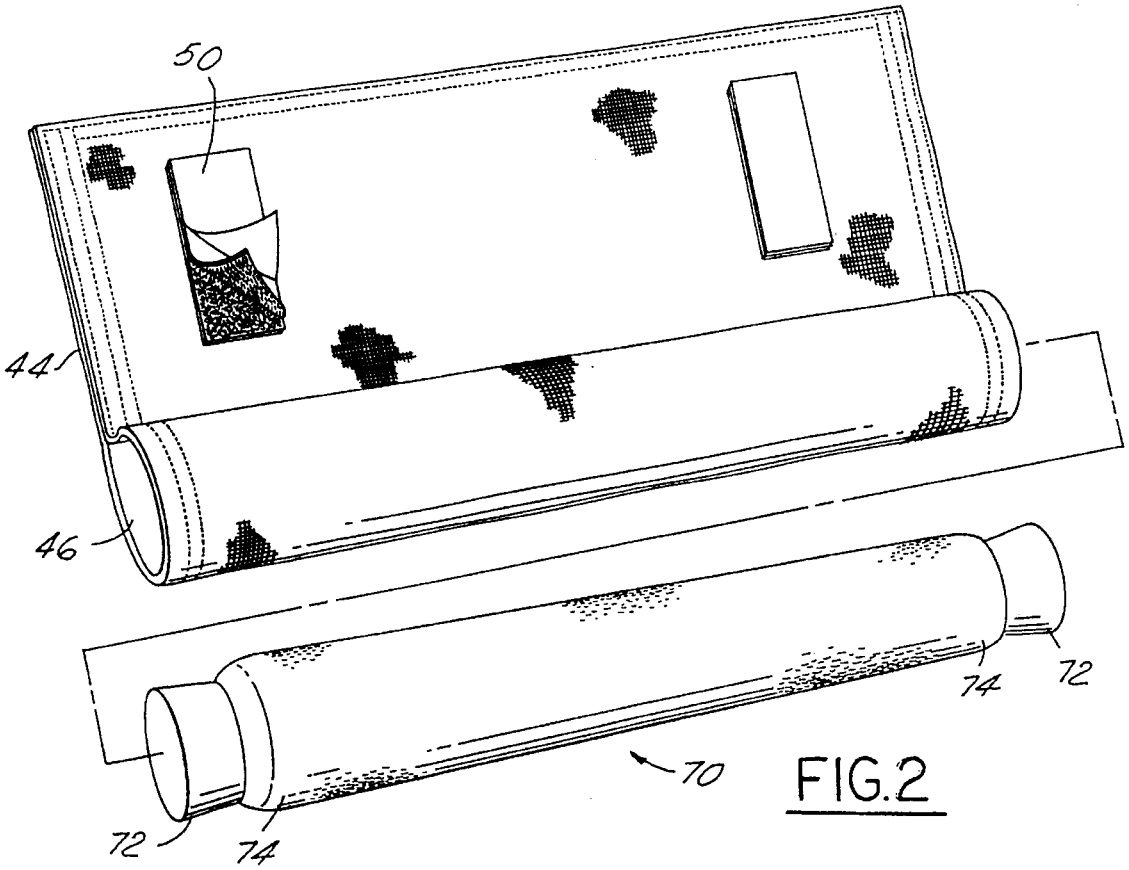
FIG. 2 is an exploded perspective view of the hand/wrist rest support showing the resilient core prior to insertion into the tubular cover portion of the base of the hand/wrist rest support.

FIG. 1 illustrates a notebook size computer 10 having a screen 12 and an attached keyboard 14. An operator or user P has his or her hands on the keyboard 14 with the heel of the hands resting upon and supported by the hand/wrist rest support 16 of the present invention. The length of the hand/wrist rest support 16, which is also shown in FIG. 2, is approximately 12½ inches in length.

Figure 3:
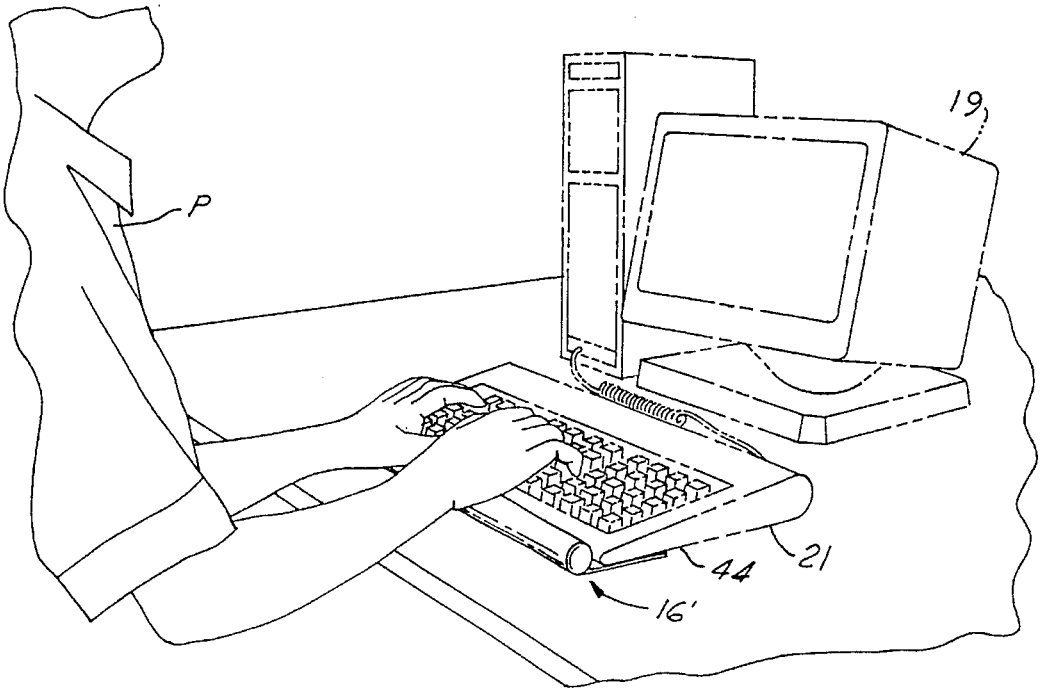
FIG. 3 is a perspective view of a computer with a stand alone keyboard employing the hand/wrist rest support of the present invention.

FIG. 3 illustrates a perspective view of a computer system containing a standard computer terminal 20 and keyboard 22. The person P has his/her hands on the keyboard with the wrists supported by the hand/wrist rest support 16' of the present invention. Support 16' has a length of approximately 18½ inches.

Both hand/wrist rest supports 16 and 16' are of similar construction and are each made according to the same method described herein. The structural differences between hand/wrist rest supports 16 and 16' will be described hereinafter.

The hand/wrist rest support 16 is made from commercially available materials which are cut, shaped and secured together to form the hand/wrist rest support.

Figure 5A:
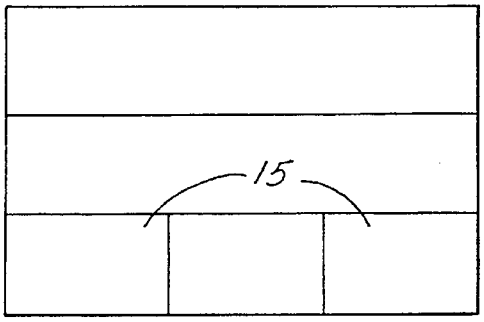
FIG. 5A is a plan view of a large sheet of fabric material provided with chalk marks or lines prior to cutting the material to the appropriate size for making the base of the support for a standard computer.
Figure 5B:
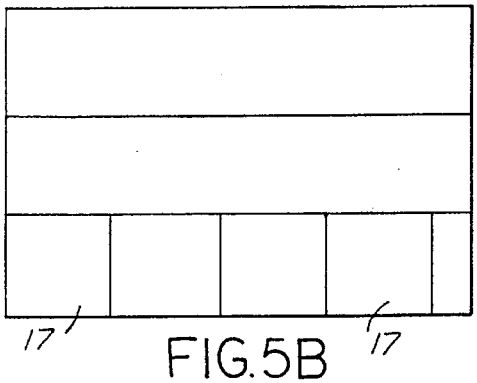
FIG. 5B is a plan view of a large sheet of material appropriately marked prior to cutting the material in order to form the base suitable for making a hand/wrist rest support for use with a notebook size computer.
Figure 6:
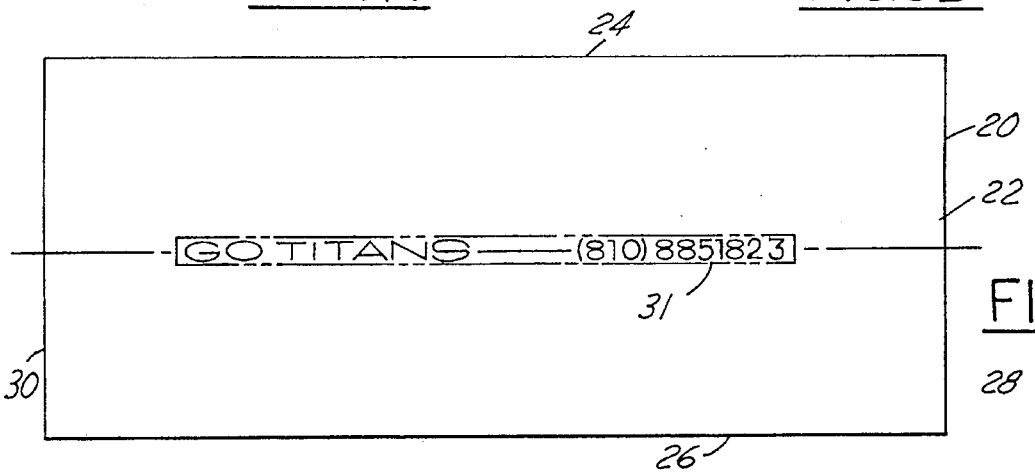
FIG. 6 is a plan view of a sheet of material forming the base.

Initially, as an example, a roll of cotton is cut. The cotton is commercially available in 10 ounce PSY, 60 inch wide. The cotton is initially cut as indicated in FIGS. 5A and 5B so as to divide the roll into 15 sheets which are 13 inches by 20 inches to form the base of the hand/wrist rest support 16' as shown in FIG. 5A. In order to make the notebook size hand/wrist rest support 16, the cotton roll is marked and cut into sheets 17 measuring 13 inches by 14 inches as represented by FIG. 5B.

The hand/wrist rest support 16 or 16' is made according to the following method steps. A sheet 20 of suitable material such as, for example, a cotton or cotton-like cloth material or a knit or woven textile material of the appropriate size as mentioned previously is placed on a support. The sheet 20 has a longitudinal axis 22 and parallel longitudinal edges 24 and 26 and a pair of parallel transverse end edges 28 and 30. The sheet 20 is initially directed to a printing station or area where a photo mechanical transfer of a suitable advertisement 31 is screen printed or impressed upon the sheet. Such advertisement 31 may consist of message including any slogans, trademarks or other message. The indicia imprinted upon the sheet 20 is placed on the material exactly on the longitudinal centerline 22. If the indicia is silk screened on the material, the material is then cured in an oven at a heating station, not shown.

Figure 7:
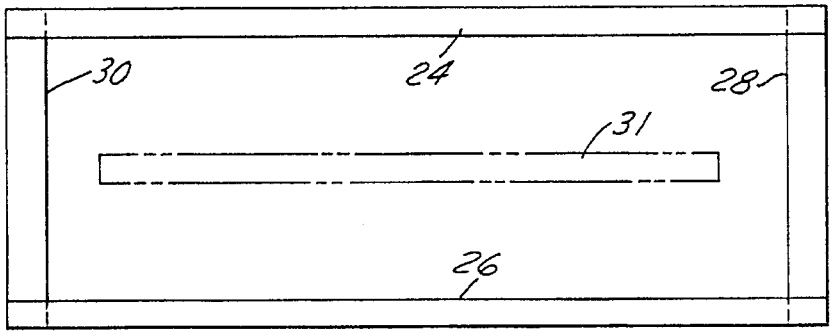
FIG. 7 is a plan view of the base with the transverse end edges, each edge bent or folded inwardly approximately ¾ of an inch.

The printed sheets 20 are removed from the oven and are taken to a sewing station or area as represented in FIG. 7. Initially, the first step of the sewing operation is to fold the edges 28 and 30 in towards each other so as to overly the adjacent portions of the sheet 20 as shown in FIG. 7. Approximately ½ of an inch of each end is turned over, the sheet 20 is then moved to a sewing station where the ends 28 and 30 are double stitched by the sewing process or machine to the underlying portion of the sheet 20. The double stitching is represented by two rows of stitches 32 and 34. It should be noted that the rough edges 30 and 28 face or are located opposite the advertisement 31. The ends 28 and 30 must be sewn evenly and perpendicular to the letters of the advertisement 31.

Figure 8:
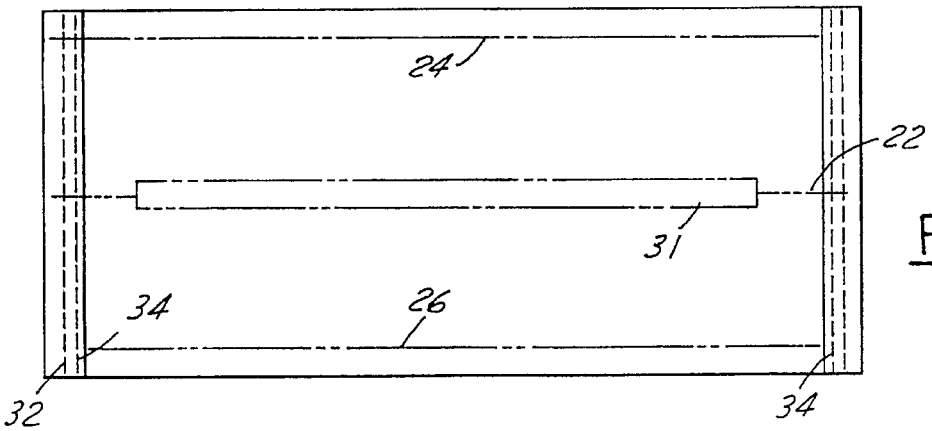
FIG. 8 is a plan view of the base showing the folded end edges being stitched to the base by a double row of stitches.

The parallel longitudinal edges 24 and 26 are also folded over so that the rough edges thereof face the advertisement 31 as represented in FIGS. 7 and 8. After the end edges 24, 26 have been stitched, it is then necessary to provide a single row of stitching approximately ½ inch from the top and bottom as represented by the row of stitches 36 as shown in FIG. 9.

Figure 9:
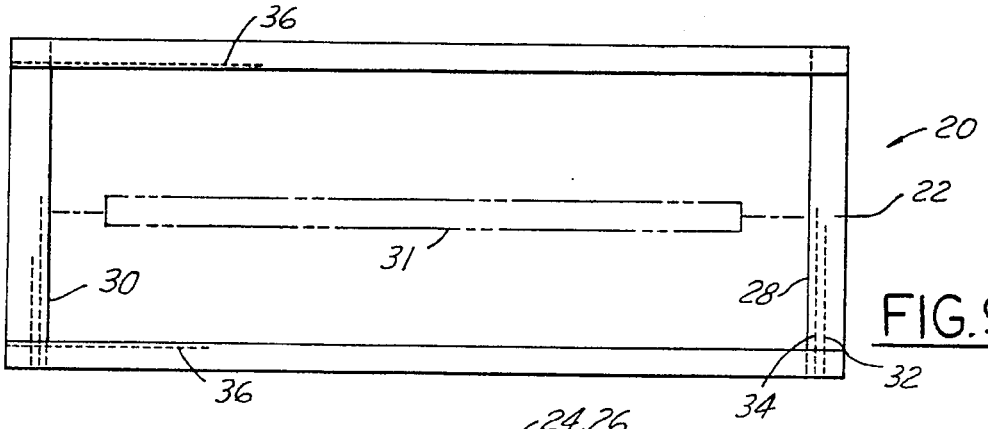
FIG. 9 is a plan view of the base showing the parallel longitudinal edges, each edge folded inwardly approximately ½ of an inch to overlie the base and to thereafter be stitched by a single row of stitches to the base.
Figure 10:
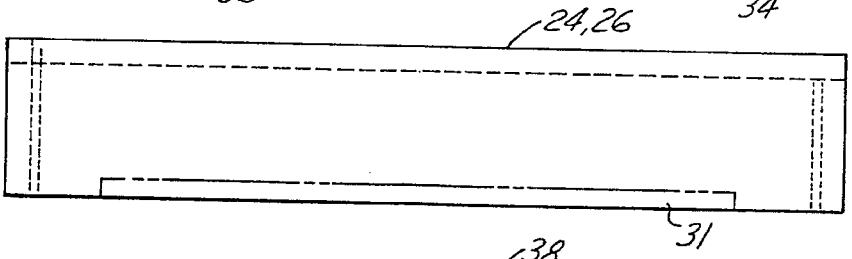
FIG. 10 is a plan view showing the base folded in half along the longitudinal centerline.
Figure 11:
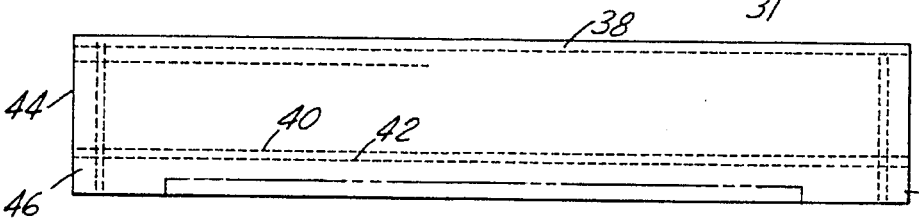
FIG. 11 shows the provision of connecting the longitudinal edges together by a row of stitches and further shows a row of stitches between the two halves so as to divide the base into a flap portion and a tubular cover portion.
Figure 12:
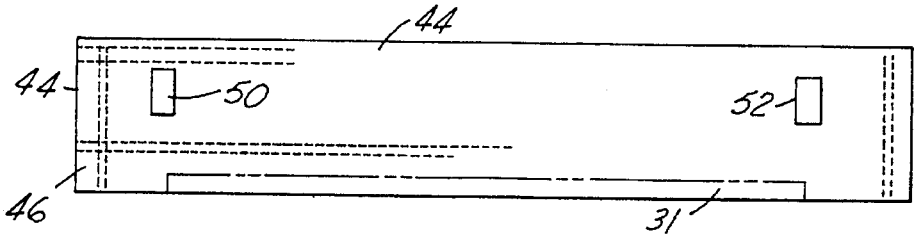
FIG. 12 is a plan view showing the top surface of the base of the support, with a pair of Velcro™ fasteners stitched thereon.

The partially sewn sheet 20 as shown in FIG. 9 is then folded in half along the longitudinal axis 22 so that the longitudinal edges 24, 26 overlap one another. The sheet or base is folded in such a manner so that the advertisement will appear on the outside as shown in FIG. 10. Once the longitudinal edges 24, 26 have been aligned as shown in FIG. 10, a single stitch line represented by the row 38 of stitches secures the longitudinal edges together. In addition, further stitching is provided along the end edges to secure the end edges together for a predetermined distance. A double row 40 and 42 of stitches are placed a predetermined distance from the longitudinal centerline 22. The hand/wrist rest support 16 includes a flap portion 44 and a tubular cover portion 46 having open ends. The top surface of the flap portion 44 is provided with hook and loop type fasteners 50 and 52. These fasteners are sold under the trademark Velcro™. The Velcro™ strips 50 and 52 are cut to size and are placed several inches from the ends as shown in FIG. 12. When the tubular cover support is of a longer dimension as an example, as in FIG. 4, then an intermediate or center Velcro™ strip if affixed to the center section. All strips are secured by sewing. The flap portion 44 is designed to fit underneath the computer terminals 14 and 22 as shown in FIGS. 1 and 3. The Velcro™ fasteners secure the hand/wrist rest support to the terminals. The fasteners are long enough to allow for some variation for the variable of the hand size.

Figure 13:
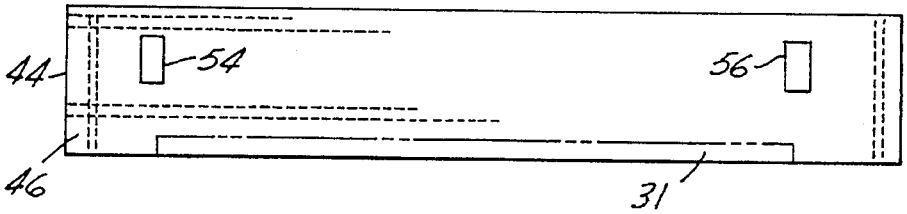
FIG. 13 is a bottom plan view of the base of the support showing a pair of non-skid elements affixed to or stitched to the flap portion.

The bottom surface of the flap portion 44 is shown in FIG. 13 and is provided with a pair of non-slip elements 54 and 56 which are located on the flap portion directly beneath the Velcro™ fasteners 50 and 52. Both the Velcro™ fasteners 50 and 52 and the non-slip elements 54 and 56 may be temporarily secured in place by staples prior to the components or accessories being secured to the flap portion 44 by stitching or by other suitable means. The non-slip elements 54, 56 may also be glued on. A non-slip roll on paint polymer may also be used to increase the friction. This type of non-slip element would be painted on with the use of a template and allowed to dry prior to packaging.

Figure 4:
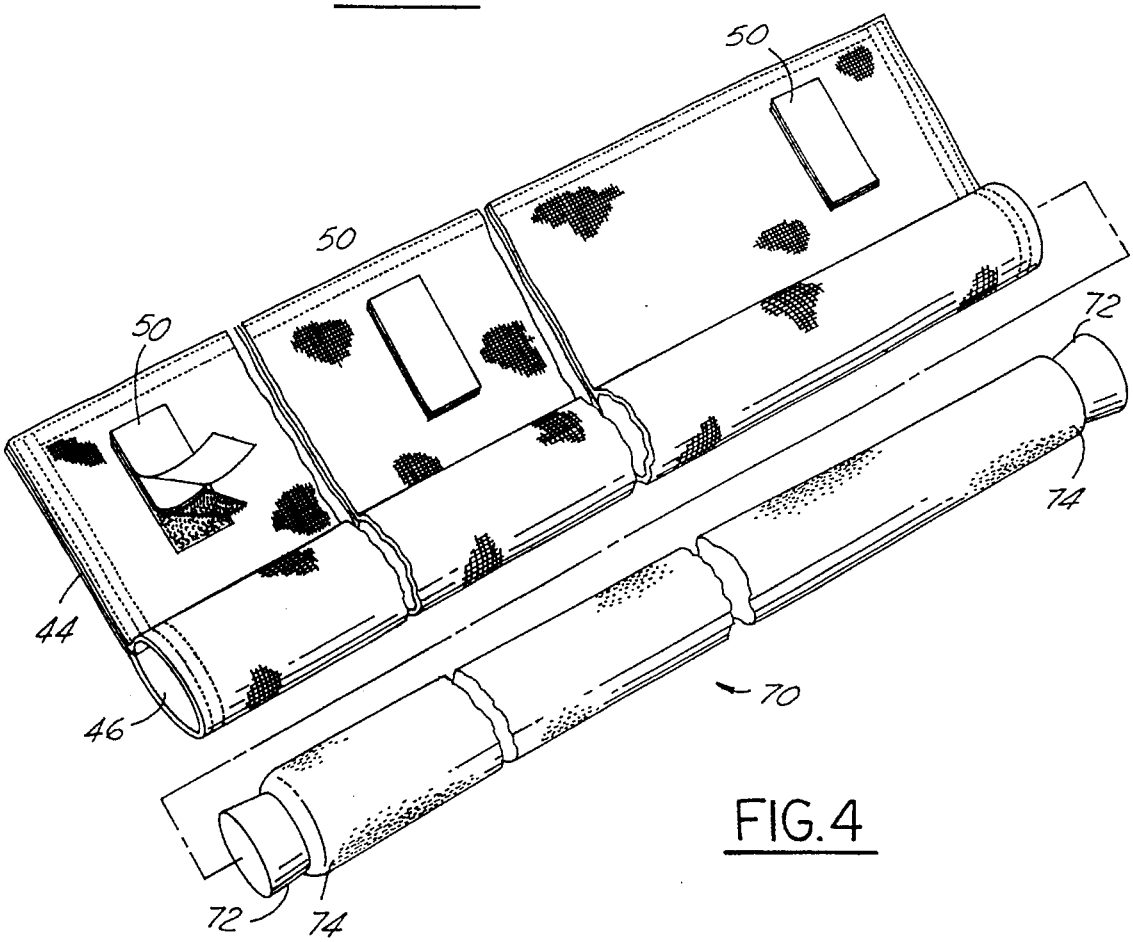
FIG. 4 is an exploded perspective view, with parts broken away, of another embodiment of the hand/wrist rest support and showing the resilient core prior to insertion into the tubular cover portion of the base of the support.
Figure 14:
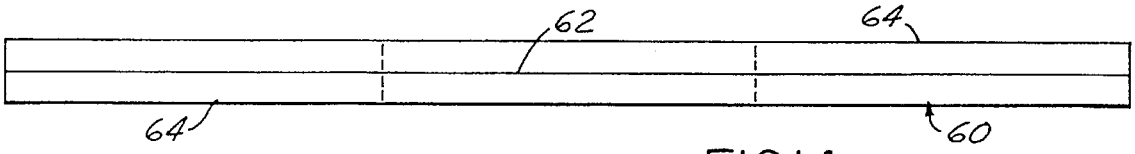
FIG. 14 is an elevational view of the cylindrical foam wrap or core, showing the manner in which it is cut in half longitudinally and is then cut into three sections of equal length depending on the length of the tubular cover portion of the base.
Figure 15:
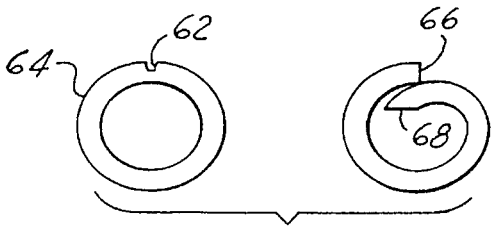
FIG. 15 illustrates the manner in which the cylindrical tubular foam wrap is cut or notched longitudinally so that one longitudinal edge thereof may be folded inside the other longitudinal edge so as to reduce the overall cross-sectional dimension of the core.
Figure 16:
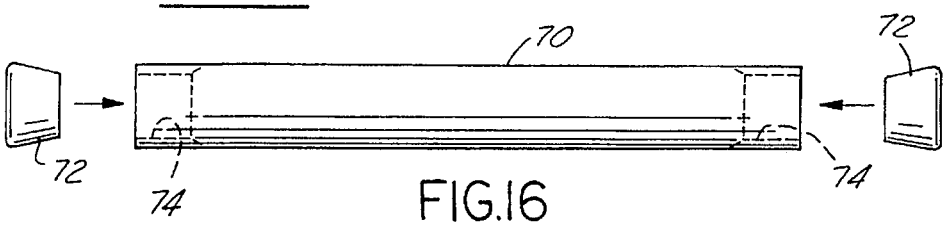
FIG. 16 is an elevational view of the core after it has been sized and prior to the insertion of the end caps.

FIG. 14 shows a cylindrical foam wrap of tubular form. The wrap or sleeve is designated by the numeral 60. A longitudinal slot 62 is cut lengthwise in the sleeve 60. Thereafter the sleeve 60 is separated into cores or elements 64. Each element 64 is of a required length in order to fit the length of the tubular cover portion 46 of the hand/wrist rest support. The core or element 64 is made from polyethylene foam. Each element 64 is interrupted or broken along the line 62 to form longitudinal edges 66 and 68. The longitudinal edge 68 is turned into the longitudinal edge 66 as shown in FIG. 15. The foam wrap is rolled into the appropriate size and configuration to form the wrapped core 70. Plastic end caps 72 are glued and inserted into the ends 74 of the wrapped core 70. The plastic end caps may vary in shape. Thereafter, the wrapped core 70 is inserted into the tubular portion 46 so as to form the hand/wrist rest support 16 (FIG. 2) or the hand/wrist rest support 16' (FIG. 4).

It is also contemplated that the step of printing information on the sheet 20 will take place after all the sewing steps or operations are completed.

Figure 17:
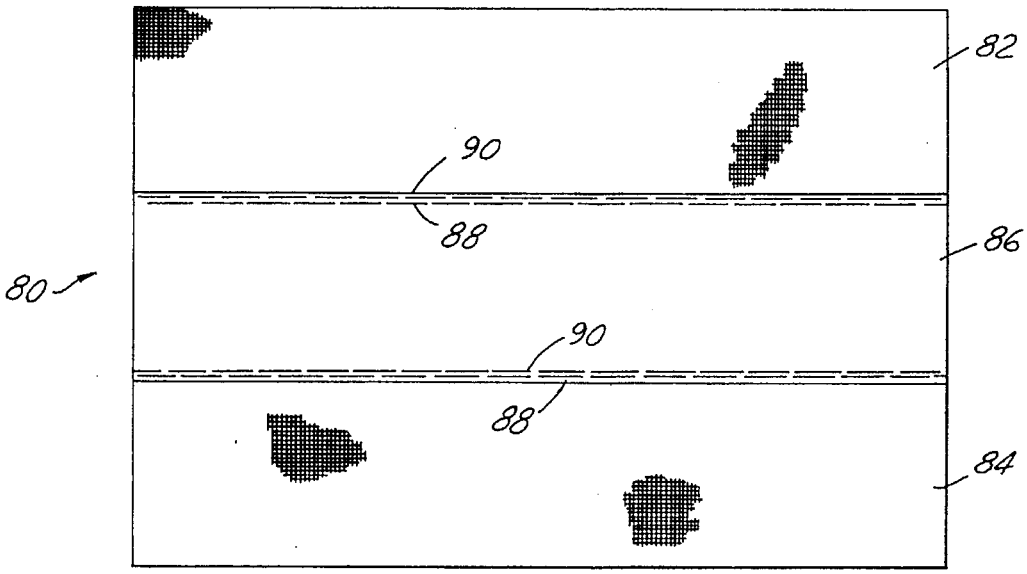
FIG. 17 is a plan view of a modified base made, as an example, from a plurality of materials such as cotton and leather and illustrating the manner in which the pair of cotton strips are stitched to the center leather strip.

FIG. 17 illustrates a modification of the present invention. A composite sheet or base 80 is formed from three pieces of materials that are stitched together to form a rectangular base having the appropriate length and width. The two outer strips 82 and 84 are cotton while the center strip 86 may be either leather or vinyl. Strip 86 is double stitched to the cotton strips 82 and 84 by double rows 88 and 90 of stitches. Prior to the stitching, the top cotton strip 82 is screened printed to apply the appropriate trademark, logo, advertisement or other indicia as may be required. Advertisement is approximately 2 inches from the side and 1.5 inches from the top except for the screen printing of the advertisement. Where the leather/vinyl strip 86 is to be used for the advertisement, such indicia will be embroidered or embossed thereon instead of screen printed.

While I have referred to the word "cotton" throughout the specification, it should be understood that in order to meet the ergonometric requirements, the base should form an outer cover made of soft, absorbent and easily washable fibrous yarn material such as, for example, a cotton or cotton-like material or a knit or woven textile material. Encased within the tubular portion of the base is an easily washable polyethylene foam material or the like. The resilient core can be removed from the tubular portion and washed or replaced with a new resilient core when the old core is worn out.

As can be seen from FIG.1 and 3, the top of the resilient core is high enough so that the heel of the hands or the wrists of an operator will rest naturally on the hand/wrist rest support 16, 16' while the operator is using the keyboard. Because of the material selected, the outer surface of the hand/wrist rest support 16 will remain warm and soft to the touch. In addition, there are no hard or sharp parts provided so that the undersides of the wrists will not engage any hard or sharp parts or edges.

The hand/wrist rest support is intended to be used below the heel of the hands during typing operations, although some people may find it more comfortable when used directly below the wrist.

The hand/wrist rest support indirectly rests the wrist through support under the heel of the hands thus maintaining a neutral wrist posture during typing operations. Proper ergonomic posture should also be maintained during the use of this product through chair and work station adjustments.

Although several embodiments have been described herein, this was for the purpose of illustrating but not limiting the invention. Various modifications, which will come readily to the mind of one skilled in the art, are within the scope of the invention as defined in the appended claims.

It should be appreciated that persons have different size hands. Thus, the hand/wrist rest support may be located in front of the keyboard/computer at a variable distance to accommodate the length, size or comfort zone of the hands of the users. The adhesive hooks of fasteners 50 and 52 are placed on the keyboard at the location selected by the user to accommodate the comfort zone of the hands. After the keyboard has been attached to the hand/wrist rest support, the rest support may be further adjusted to a different comfort zone by the first user or a subsequent user.

The Velcro™ fasteners 50 and 52, has an adhesive backed hook fastener 50*a*, a looped fastener 50*b* which is stitched to the flap portion of the rest support as described previously. In addition, a removable slip or backing 50*c* covers the adhesive backed hook fastener 50*a*. Each backing 50*c* is removed at the time the hand/wrist rest support is adjusted and temporarily secured to the keyboard/computer.

What I claim is:

1. The method of making a hand/wrist rest support for a keyboard comprising the steps of:

a) forming a generally rectangular base having a longitudinal axis, said base being made from one or more sheets of flexible materials, with the base having a pair of parallel longitudinal edges and a pair of parallel transverse end edges;

b) folding the parallel end edges over adjacent portions of said base to form end edges of double thickness;

c) stitching the folded ends to said base;

d) folding the parallel longitudinal edges over adjacent portions of said base to form longitudinal edges of double thickness;

e) stitching the folded longitudinal edges to said base;

f) folding the base in half at the longitudinal axis so that one half of the base lies on the other half of the base;

g) stitching the two halves of said base together along the longitudinal edges and part way along the parallel transverse end edges;

h) stitching the two halves of said base together at a fixed distance from the longitudinal axis to divide said base into a tubular cover portion and a flap portion; and i) inserting an elongated core of yieldable material into said tubular cover portion to provide a cushion for the wrists of the user of the keyboard.

2. The method of making a hand/wrist rest support as defined in claim 1, including the step of:

providing double rows of stitching in step (c) to secure said folded end edges to said base.

3. The method of making a hand/wrist rest support as defined in claim 1, including the step of:

providing a single row of stitching in step (e) to secure said folded longitudinal edges to said base.

4. The method of making a hand/wrist rest support as defined in claim 1, including the step of:

providing double rows of stitching in step (g).

5. The method of making a hand/wrist rest support as defined in claim 1, including the step of:

providing one or more rows of stitching in step (h) to form said tubular cover portion and said flap portion.

6. The method of making a hand/wrist rest support as defined in claim 1, including the step of:

printing indicia on the upper surface of said tubular cover portion.

7. The method of making a hand/wrist rest support as defined in claim 6, wherein said printing step is performed prior to step (b) and along the longitudinal axis of said base.

8. The method of making a hand/wrist rest support as defined in claim 6, wherein said printing step is performed after all stitching steps are completed.

9. The method of making a hand/wrist rest support as defined in claim 1, including the step of:

taking a roll of fabric material and cutting it to size to form the rectangular base.

10. The method of making a hand/wrist rest support as defined in claim 1, wherein said base is made from cotton and said core is made from polyethylene foam.

11. The method of making a hand/wrist rest support as defined in claim 1, including the step of:

stitching hook and loop type fastening elements to the upper surface of said flap portion.

12. The method of making a hand/wrist rest support as defined in claim 1, including the step of:

applying non-slip elements to the lower surface of said flap portion.

13. The method of making a hand/wrist rest support as defined in claim 1, wherein said sheet is made from strips of cotton and leather which are stitched together to form said base.

14. The method of making a hand/wrist rest support for a keyboard comprising the steps of:

a) forming a generally rectangular base having a longitudinal axis, said base being made from one or more sheets of flexible materials, with the base having a pair of parallel longitudinal edges and a pair of parallel transverse end edges;

b) folding the parallel end edges over adjacent portions of said base to form end edges of double thickness;

c) stitching the folded ends to said base;

d) folding the parallel longitudinal edges over adjacent portions of said base to form longitudinal edges of double thickness;

e) stitching the folded longitudinal edges to said base;

f) folding the base in half at the longitudinal axis so that one half of the base lies on the other half of the base;

g) stitching the two halves of said base together along the longitudinal edges and part way along the parallel transverse end edges;

h) stitching the two halves of said base together at a fixed distance from the longitudinal axis to divide said base into a tubular cover portion and a flap portion;

i) inserting an elongated core of yieldable material into said tubular cover portion to provide a cushion for the wrists of the user of the keyboard; and j) placing end caps at the ends of said elongated core prior to inserting said elongated core into said tubular cover portion.

* * * * *